US008464368B2

(12) United States Patent
Edwards

(10) Patent No.: US 8,464,368 B2
(45) Date of Patent: Jun. 18, 2013

(54) ELEVATED TOILET SEAT

(75) Inventor: Neil Edwards, Kernersville, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 717 days.

(21) Appl. No.: 12/580,541

(22) Filed: Oct. 16, 2009

(65) Prior Publication Data

US 2011/0088155 A1 Apr. 21, 2011

(51) Int. Cl.
*A47K 13/28* (2006.01)

(52) U.S. Cl.
USPC ..... 4/237; 4/254

(58) Field of Classification Search
USPC ..... 4/237–239, 254
See application file for complete search history.

(56) References Cited

U.S. PATENT DOCUMENTS 3,285,551 A 11/1966 Tschanz
3,667,783 A 6/1972 Sotolongo
4,213,211 A * 7/1980 Bemis et al. ..... 4/239
4,250,348 A 2/1981 Kitagawa
4,358,079 A 11/1982 Navarro
4,387,267 A 6/1983 Becker
4,513,172 A 4/1985 Matsui
4,738,636 A 4/1988 Bolante
4,787,657 A 11/1988 Henniger
4,814,547 A 3/1989 Riley et al.
4,891,470 A 1/1990 Studenski
5,068,496 A 11/1991 Favalora
5,132,493 A 7/1992 Sheehan
5,866,853 A 2/1999 Sheehan
6,905,080 B2 6/2005 Pohorecki
7,185,923 B2 3/2007 McNeil et al.
7,240,377 B2 * 7/2007 Vanden Heuvel ..... 4/237
7,774,868 B2 * 8/2010 Landsberger et al. ..... 4/237

* cited by examiner

*Primary Examiner* — Huyen Le
(74) *Attorney, Agent, or Firm* — Carlson, Gaskey & Olds, PC

(57) ABSTRACT

A toilet seat elevates from a first elevation to a second elevation. If in the first elevation, the toilet bowl seat appears to be a normal toilet bowl seat. To elevate the toilet bowl seat the toilet bowl seat is guided in a slot and locked into an upper elevation and support legs depend downwardly from the seat.

33 Claims, 5 Drawing Sheets

FIG.3A
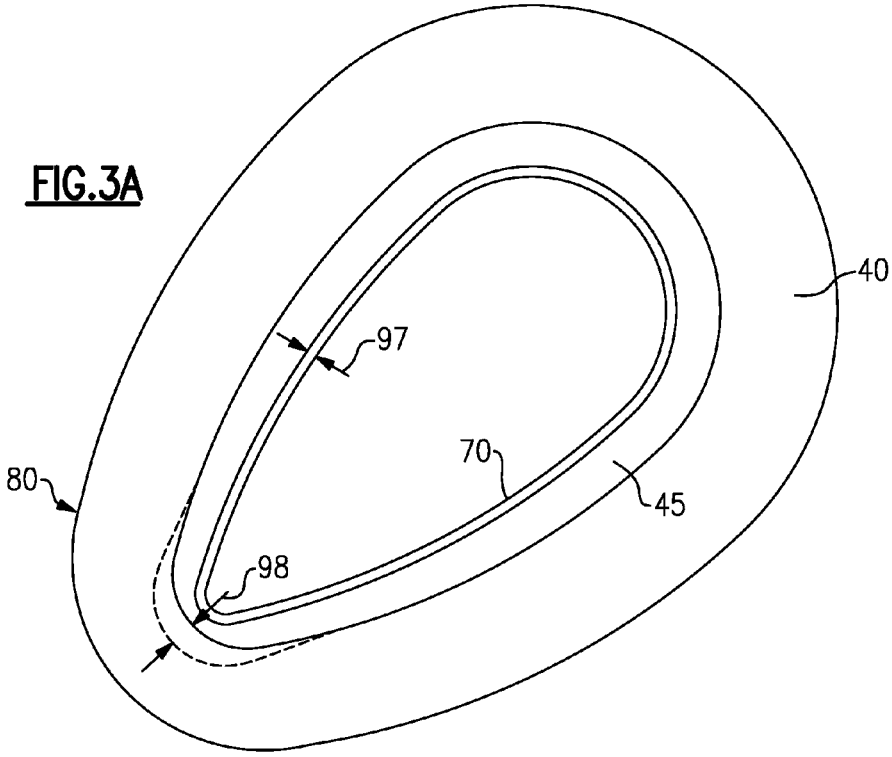
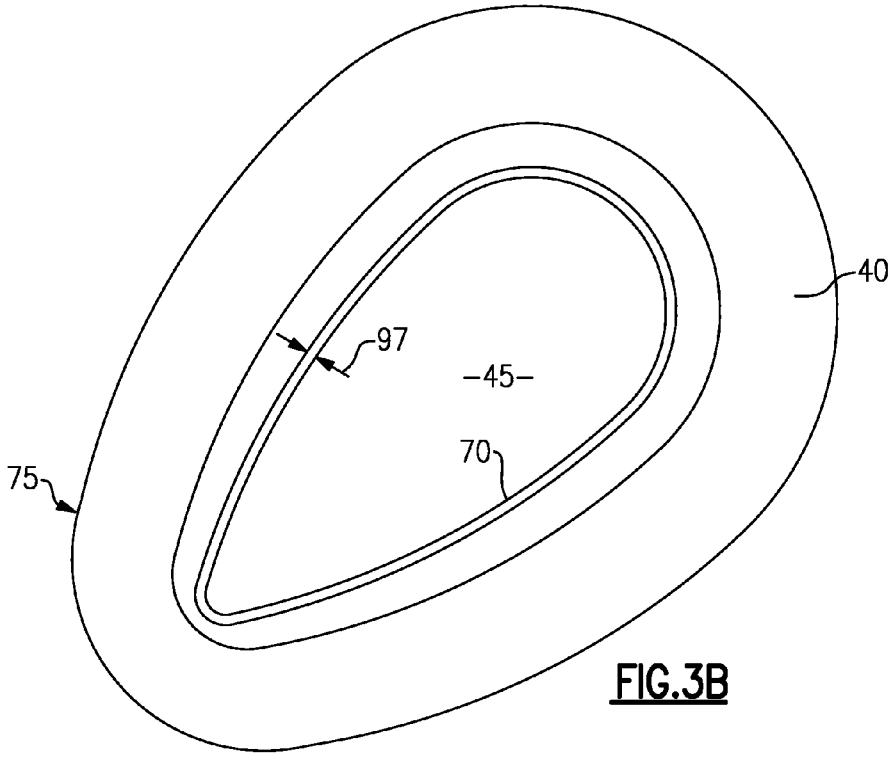
FIG.3B

ELEVATED TOILET SEAT

BACKGROUND OF THE INVENTION

Some people have infirmities that make it difficult to use toilets at the height that they are typically manufactured. As a result, many companies manufacture toilet seats that allow a user to sit more comfortably at a higher elevation than existing toilet seats.

Other types of elevated toilet seats are sought.

SUMMARY OF THE INVENTION

According to a non-limiting embodiment, a toilet seat has an opening and a shape, a first support extending downwardly from said seat, and a bracket attaching to the seat at a lower first elevation or at a higher second elevation.

According to a further non-limiting embodiment of the invention, a toilet seat has an opening of a given shape, a tube conforming to the shape of the seat and extending downwardly therefrom, and a bracket attaching to the seat at a lower first elevation or a higher second elevation.

According to a further non-limiting embodiment of the invention, a toilet has a bowl having an opening defined by a ledge, a seat having an opening, a bracket attaching to the seat at a lower first elevation or a higher second elevation and, a first support extending downwardly from the seat into the bowl.

According to a further non-limiting embodiment of the invention, a base has an opening defined by a ledge, a seat, a bracket attaching to the seat at a lower first elevation or a higher second elevation and, a first support extending downwardly from the said seat into the opening.

When the toilet seat is not in use, a user may lower it to give a casual observer the impression that there is no one in the home that is infirm. At the upper elevation, the seat allows an infirm user to use the toilet more easily. The toilet may also be shared by a non-infirm user who can simply use the toilet seat at the lower elevation.

BRIEF DESCRIPTION OF THE DRAWINGS

The various features and advantages of the disclosed examples will become apparent to those skilled in the art from the following detailed description. The drawings that accompany the detailed description can be briefly described as follows.

FIG. 3A is a sectional view taken along lines 3A of FIG. 2.

FIG. 3B is a sectional view taken along lines 3B of FIG. 1.

DETAILED DESCRIPTION OF THE PREFERRED EMBODIMENT

Figure 1:
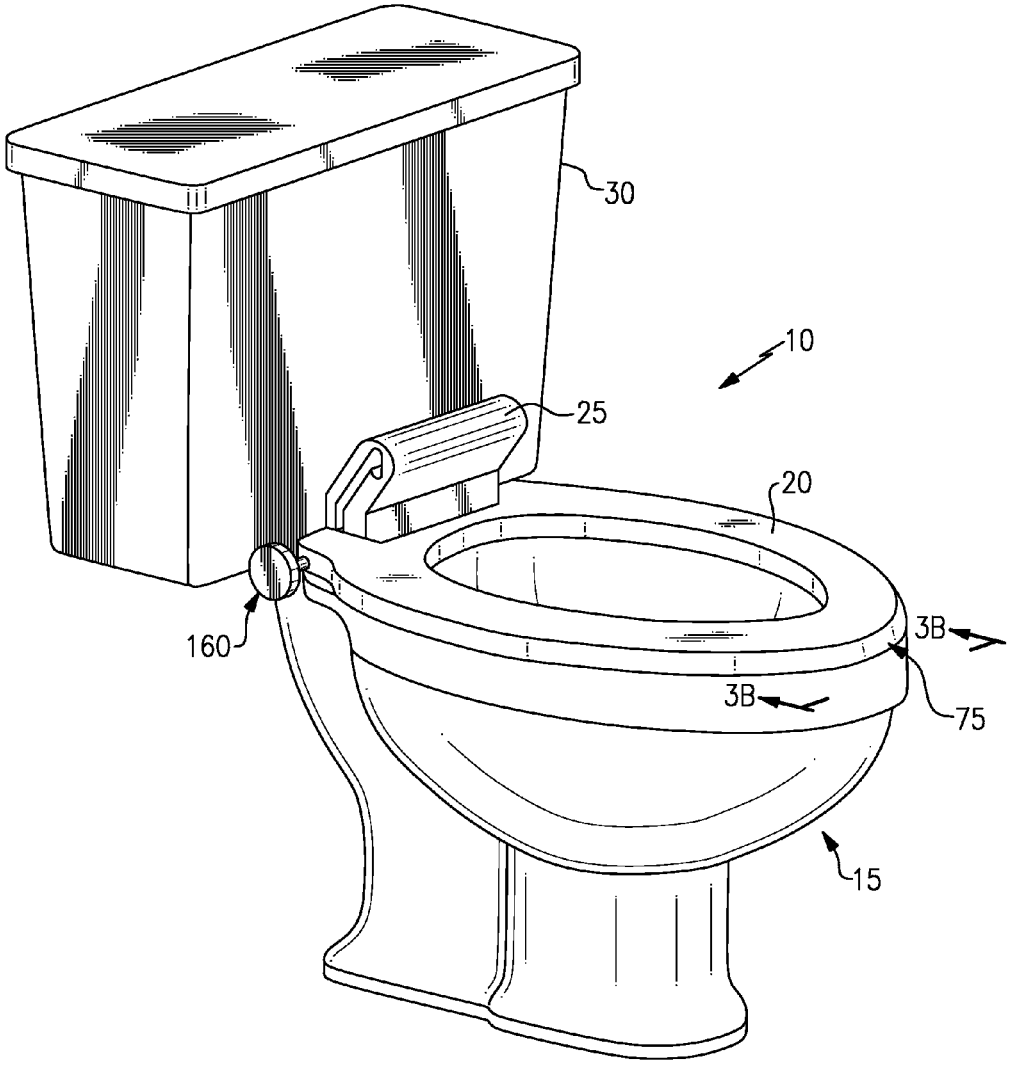
FIG. 1 is a first embodiment of the toilet seat shown in perspective at a first elevation.
Figure 2:
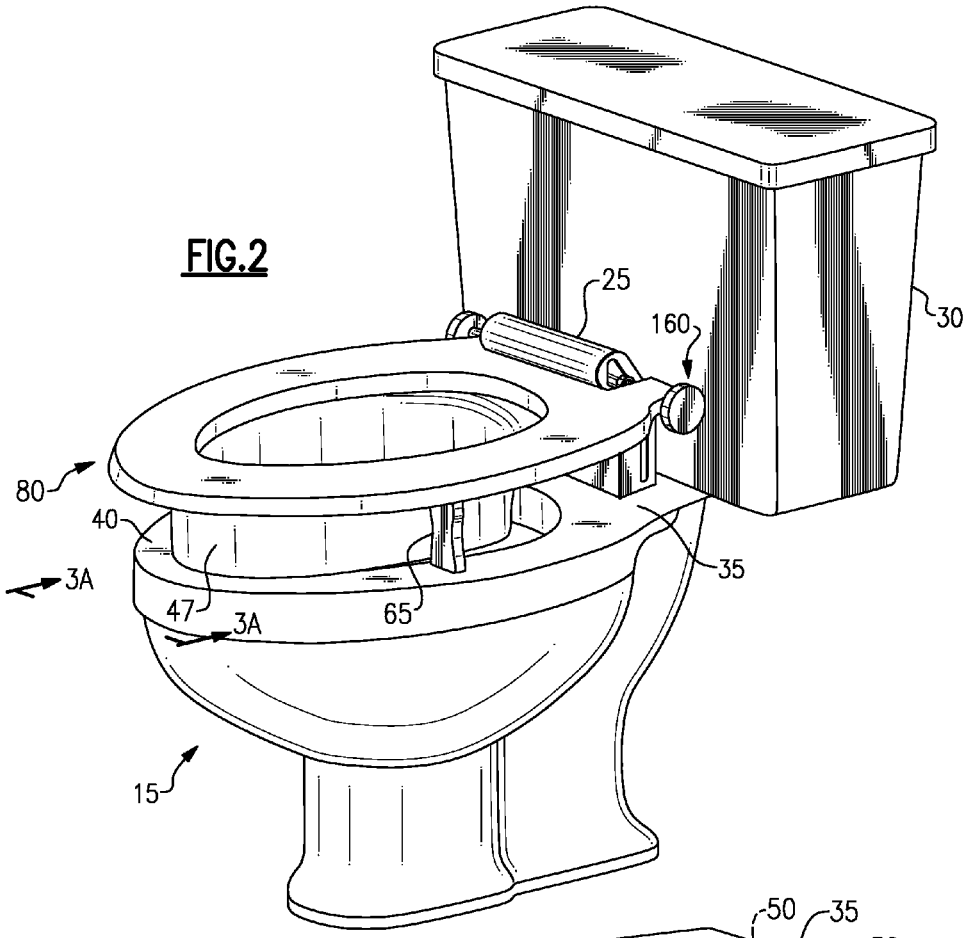
FIG. 2 is a perspective view of the toilet seat in a second elevation.

Referring to FIGS. 1 and 2, the toilet seat 10 is shown. The invention includes a toilet bowl 15, a seat 20, a bracket 25, and a tank 30. The toilet seat is shown in FIG. 1 at a first elevation 75 and is shown in FIG. 2 at a second elevation 80.

Figure 2A:
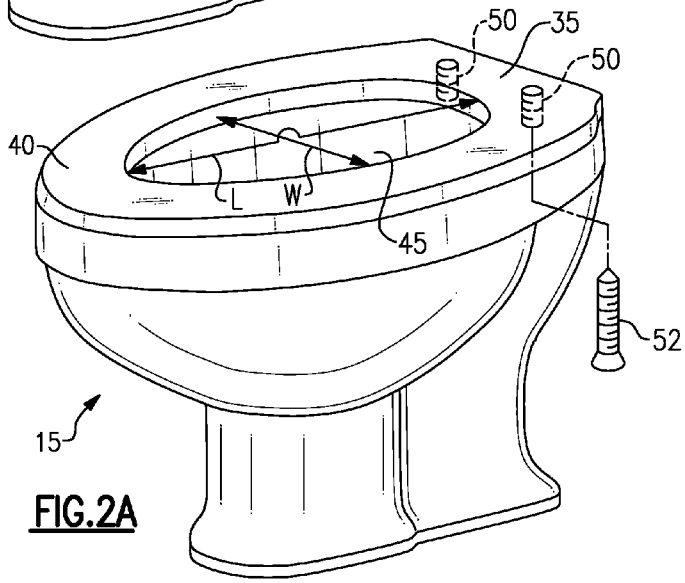
FIG. 2A is a perspective view of the toilet of FIGS. 1 and 2.

Referring to FIG. 2A, the toilet bowl 15 has a support portion 35, a ledge 40, bowl opening 45 having a length L and a width W and a pair of through holes 50. A pair of screws 52 extend through the holes 50 to attach to the bracket 25 as will be discussed herein. A tank 30 attaches to the support portion 35 of the bowl behind the through holes 50.

Figure 3:
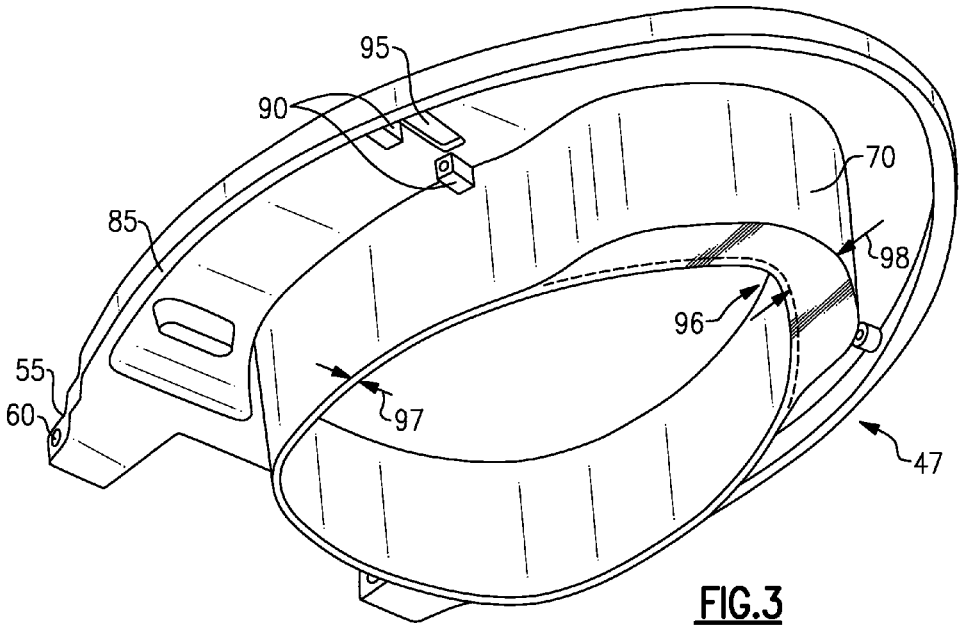
FIG. 3 is a perspective view of an embodiment of the toilet lid of FIG. 1.

Referring to FIGS. 2 and 2A and 3, the seat 20 and has a downwardly extending tube 47, a pair of ears 55 each ear 55 having an opening 60 extending therethrough, and a pair of support arms 65 (see FIG. 2) as will be discussed herein. The tube has a contour 70 that extends downwardly so that the seat may rotate about its ears 55 without striking the bowl opening 45 in either the first elevation 75 (see FIG. 1) or the second elevation 80 (see FIG. 2). The seat has a set of downwardly depending lugs 85 to allow the seat 20 to sit on the ledge 40 and allow the support arms 65 space if the seat 20 is at the first elevation 75. The seat 20 has a pair of bosses 90 for holding a support arm 65 and a pair of rectangular recesses 95 each retaining a support arm therein if in the second position 80.

Referring to FIG. 3, the tube bottom 96 has a width 97 and an extended width 98 as will be discussed hereinbelow. The tube acts as a funnel for effluent (not shown) and as a support.

Figure 4:
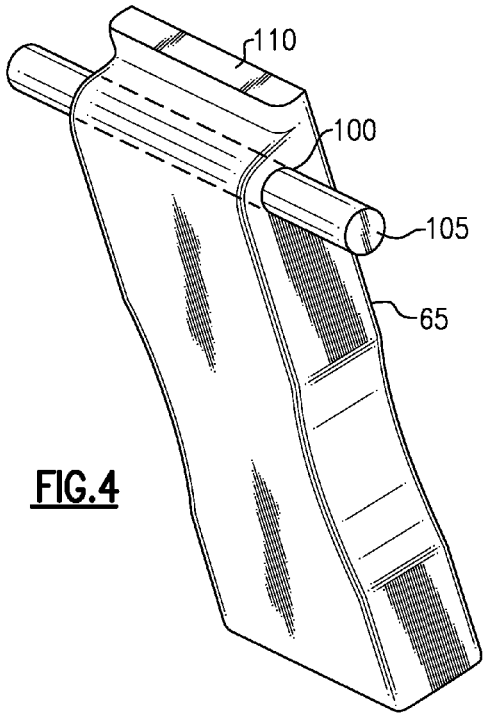
FIG. 4 is a perspective view, partially in phantom, of the support arm of FIG. 2.

Referring to FIG. 4, a support arm 65 having a rectangular shape, a recess 100 for allowing rod 105 to pass therethrough and a rectangular cap 110 extending from the top thereof is shown. The rod is seated in the lugs 90 in the seat bottom and the support arms may rotate about the rods. The rectangular cap 110 is sized to and comprised of a suitable material to snap fit into the rectangular recesses 95 so that the seat may securely be supported on the ledge 40 if the seat 20 is in the second elevation 80 (see FIG. 2). The support arms provide support and lateral stability to the toilet seat.

Figure 5:
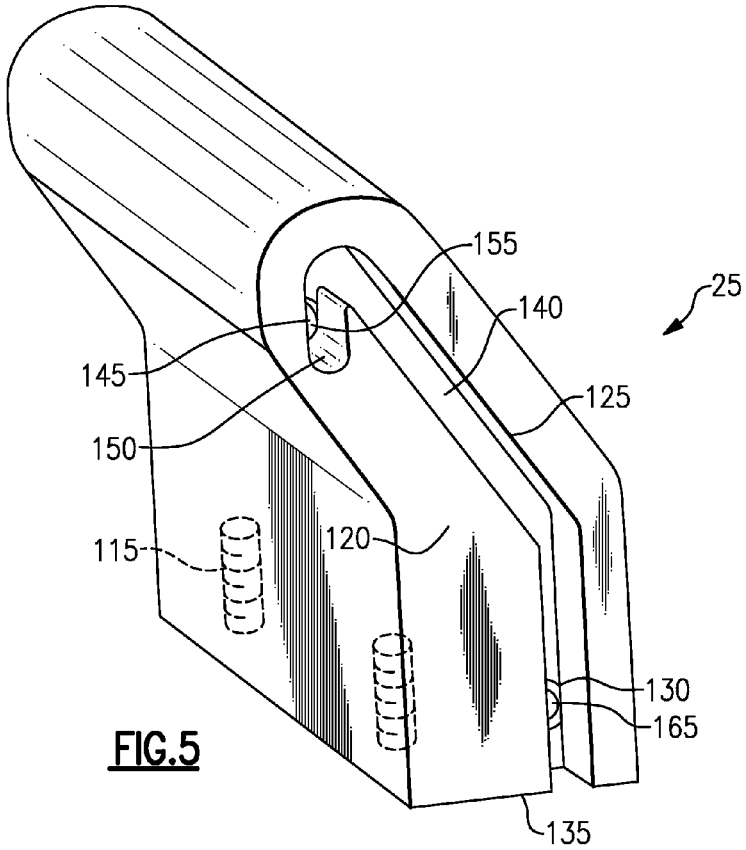
FIG. 5 is a perspective view, partially in phantom, of the bracket of FIG. 1.

Referring to FIG. 5, the bracket 25 in the non-limiting embodiment shown is a solid piece. The bracket has a pair of threaded holes 115, each hole receiving a mounting screw 52 through the through holes 50 of the bowl shown in FIG. 2A. To attach the bracket 25 to the toilet bowl 15, one centers the bracket 25 over the through holes 50 and twists the screws 52 through the through holes 50 into the threaded 115 holes to secure the bracket thereto.

The bracket 25 has on each side portion 120 thereof, a tortuous slot 125 that has a first portion 130 extending upwardly from the bottom 135 of the bracket 25, a second portion 140 that extends upwardly and inwardly towards the bowl opening 45 from the first portion and a third portion 145 extending downwardly from the second portion towards the bottom of the bracket 135. In the third portion 145, at the bottom 150 thereof, a hole 155 is inserted that is deeper than the slot for use with the locating mechanism 160, as will be discussed herein. Another hole 165 that is deeper than the slot for use with the locating mechanism 160 is disposed in the slot 125 near the bottom 135 of the bracket.

Figure 6:
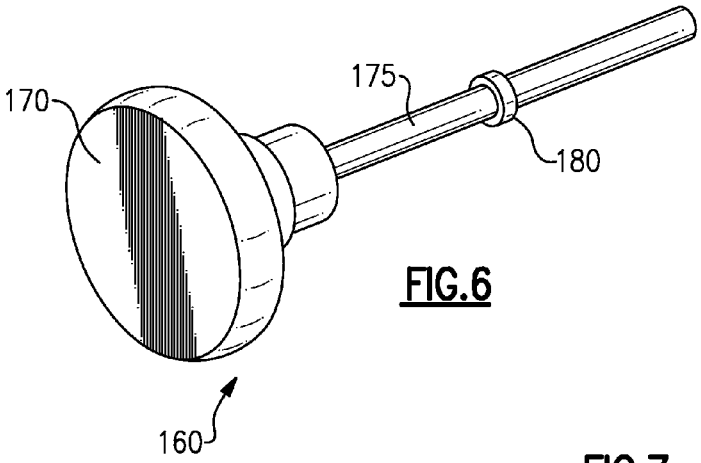
FIG. 6 is a perspective view of the locating mechanism of FIG. 1.

Referring to FIG. 6, the locating mechanism 160 is shown. The locating mechanism has an ergonomic handle 170, a seating shaft 175, and a limit washer 180. The seating shaft is inserted through the opening 60 in the ears 55 and the limit washer 180 is disposed around the seating shaft such that pulling on the ergonomic operating handle, will not allow the seating shaft to be removed from the slot 125 in the bracket 25 because the limit washer will not extend through the opening 60. Despite any movement of the ergonomic handle, the seating shaft 175 does not leave the slot 125.

To manipulate the locating mechanism, the toilet seat 25 is at the first elevation 75 as shown in FIG. 1 seated upon the ledge 40 of the toilet bowl 15 with the seating shaft disposed in hole 165 at the bottom of the bracket 25. If a user desires to move the toilet seat 20 into the second elevation as shown in FIG. 2, the user grasps ergonomic handle 170 and pulls the seating shaft 175 out of the hole 165. The slot 125 acts as a guide for the user who then moves the toilet seat upwardly in first portion 130 of the slot, upwardly and forwardly in second portion 140 of the slot and downwardly in the third portion 145 of the slot 125. The user then pushes the ergonomic handle 170 into the bracket where the seating shaft seats securely in the hole 150. A user then rotates the legs 65 until the rectangular cap 110 snaps into the rectangular recess 95 (see FIG. 3) to support the seat 20 at the second elevation. To reverse the process, user unsnaps the rectangular cap 110 out of the rectangular recess 95 and rotates the leg 65 out of the way. The user grasps ergonomic handle 170 and pulls the seating shaft 175 out of the hole 150. The slot 125 again acts as a guide for the user who then moves the toilet seat upwardly in the third portion 145 of the slot 125, downwardly and backwardly in second portion 135 of the slot, and downwardly in the first portion 130 of the slot. The user then pushes the ergonomic handle 170 into the bracket where the seating shaft seats securely in the hole 165 thereby holding the seat in the first elevation 75. A user will readily appreciated that the slot 125 may have different shapes to enable the seat 25 to be moved from the first position to the second position and back while still allowing room for the seat to lock in the first and second elevations 75, 80 and allow the seat to rotate about its ears 55 to an upward position to allow for cleaner urination. One may observe that the tube in the seat is moved forward due to the shape of the slots.

Referring to FIGS. 2, 3A, and 3B by moving the toilet forward, a user brings at least a portion of the extended width 98 onto ledge 40 to provide support to a user when sitting on the seat 20 in the second elevation 80. However, because at least a portion of the width 97 still overhangs the bowl opening 45, user effluent drops into the bowl opening 45. If the toilet seat is at the first elevation 75, the tube fits entirely within the bowl. The tube is designed and sized to fit over the bowl opening.

The toilet seat herein provides several advantages. Because the seat 20 can be stowed in the first elevation 75, other people using the toilet may not perceive that the owner of the toilet has an infirmity. And, there is no elevated toilet seat that can be perceived to be an eyesore. Also, because of the easy to use locating mechanism 160, the toilet may be easily shared by the infirm and others.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

Figure 7:
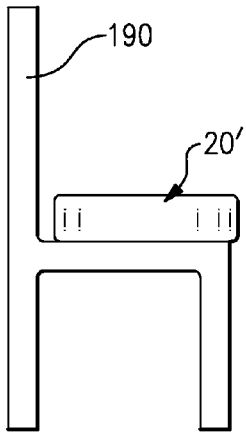
FIG. 7 is a schematic representation of a chair utilizing the toilet seat of FIG. 1.

The preceding description is exemplary rather than limiting in nature. Variations and modifications to the disclosed examples may become apparent to those skilled in the art that do not necessarily depart from the essence of this disclosure. For instance, the principles of this invention for a seat 20' may also apply to a chair 190 (FIG. 7) for which multiple heights are desired. The scope of legal protection given to this disclosure can only be determined by studying the following claims.

What is claimed:

1. A toilet seat comprising:

a seat having an opening and having a shape, a first support extending downwardly from said seat, and a bracket attaching to said seat to selectively allow said seat to move between a lower first elevation and a higher second elevation, and wherein said first support is configured to fit within a toilet bowl opening when in said lower first elevation.

2. The toilet seat of claim 1 wherein said bracket further comprises an engagement for holding said seat at said higher second elevation.

3. The toilet seat of claim 2 wherein said engagement comprises a hole disposed in said bracket.

4. The toilet seat of claim 1 wherein said bracket further comprises a first slot for guiding said seat upwardly from said first lower elevation.

5. The toilet seat of claim 4 wherein said bracket further comprises a second slot extending from said first slot for guiding said seat from said first slot to an engagement.

6. The toilet seat of claim 5 wherein said engagement comprises a hole disposed in said bracket.

7. The toilet seat of claim 5 wherein said bracket further comprises a third slot extending downwardly from said second slot for guiding said seat from said second slot to said engagement.

8. The toilet seat of claim 7 wherein said engagement comprises a hole disposed in said bracket.

9. The toilet seat of claim 1 further comprising a fastener for attaching said seat to said bracket.

10. The seat of claim 9 wherein said fastener comprises a shaft that couples said seat to said bracket and a handle that is selectively actuated to move said shaft towards and away from said bracket.

11. The toilet seat of claim 1 wherein said seat has a second support for supporting said seat when said is to be disposed in said higher second elevation.

12. The toilet seat of claim 1 wherein said first support depends downwardly from said seat and has a contour such that said first support may be moved relative to said bracket between the first lower elevation and the higher second elevation when said seat is disposed upon a toilet bowl.

13. The toilet seat of claim 1 wherein said first support has a portion for resting on a ledge surrounding a bowl opening of a toilet bowl and a second portion overhanging the bowl opening when said seat is in the higher second elevation.

14. The toilet seat of claim 1 wherein said first support is adapted to act as a funnel for directing effluent into a toilet bowl.

15. The toilet seat comprising:

a seat having an opening and having a shape, a first support extending downwardly from the seat, a bracket attaching to said seat at a lower first elevation or a higher second elevation, and a fastener for attaching said seat to said bracket wherein said fastener comprises a bolt the selectively moves toward and away from said bracket, and wherein said bolt engages a first slot in said bracket said bolt guides said is said first slot.

16. The toilet seat of claim 15 wherein said bolt engages a second slot in said bracket, said second slot extending from said first slot wherein said bolt guides said seat in said first slot and said second slot.

17. The toilet seat of claim 16 wherein said bracket further comprises a third slot extending downwardly from said second slot wherein said bolt guides said seat in said third slot and said second slot to an engagement.

18. The toilet seat of claim 17 wherein said engagement comprises a hole disposed in said bracket.

19. The toilet seat of claim 16 wherein said engagement comprises a hole disposed in said bracket.

20. A toilet seat comprising;

a seat having a shape, a support extending downwardly from said seat, a bracket attaching to said seat at a lower first elevation or a higher second elevation wherein said seat and said support are adapted to move towards a ledge edge of a toilet bowl if raised from said lower first elevation to said higher second elevation and adapted to move away from said ledge of said toilet bowl if being lowered from said higher second elevation such that said support will be hidden within the toilet bowl when in said lower first elevation.

21. A toiled seat of claim 20 wherein the support comprises a first support and including a second support that is selectively moveable relative to the first support between a storage position when the seat is in the lower first elevation and an extended support position when the seat is in the higher second elevation.

22. The toilet seat comprising:

a seat having a shape, a support extending downwardly from said seat, wherein said support is adapted to act as a funnel for directing effluent into a toilet bowl, and a bracket attaching to said seat at a lower first elevation or a higher second elevation wherein said seat and its support are adapted to move an edge of a toilet bowl if raised from said first elevation to said second elevation and adapted to move away from said edge of said toilet bowl if being lowered from said second elevation.

23. A toilet comprising:

a bowl having a bowl opening defined by a ledge, a seat having a seat opening, a bracket attaching to said seat at a lower first elevation or a higher second elevation and, a first support extending downwardly from said seat into said bowl opening.

24. The toilet seat of claim 23 wherein said first support acts as a funnel for directing effluent into a said bowl.

25. The toilet seat of claim 23 wherein said first support depends downwardly from said seat and has a contour such that said first support may be rotated about said bracket at said lower first elevation and said higher second elevation.

26. The toilet comprising:

a bowl having an opening defined by a ledge, a seat having an opening, a bracket attaching to said seat at a lower first elevation or a higher second elevation and, a first support extending downwardly from said seat into said bowl, wherein said support extends into said bowl in said lower first elevation and sits on said ledge in said higher second elevation.

27. The toilet of claim 26 wherein said seat further comprises a second support for supporting said toilet seat if said toilet seat is to be disposed in said higher second elevation.

28. The toilet seat of claim 27 wherein said second support supports said seat upon said ledge.

29. The toilet comprising:

a bowl having an opening defined by a ledge, a seat having an opening, a bracket attaching to said seat at a lower first elevation or a higher second elevation and, a first support extending downwardly from said seat into said bowl, wherein the first support fits in said bowl in said lower first elevation and overhangs said opening in said higher second elevation.

30. A chair comprising:

a base having an opening defined by a ledge, a seat, a bracket attaching to said seat at a lower first elevation or a higher second elevation and, a first support extending downwardly from said seat into said opening, wherein said support extends into said opening in said first elevation and sits on said ledge ins said second elevation.

31. The chair of claim 30 wherein said seat further comprises a second support for supporting said seat if said seat is to be disposed in said second position.

32. The chair of claim 30 wherein said second support supports said seat upon said ledge.

33. A chair comprising:

a base having an opening defined by a ledge, a seat, a bracket attaching to said seat at a lower first elevation or a higher second elevation and, a first support extending downwardly from said seat into said opening, wherein said seat and its support are adapted to move towards an edge of a said base if raised from said first elevation to said second elevation and adapted to move away from said edge of said base if being lowered from said second elevation.

* * * * *